US010407894B2

(12) United States Patent
Strickland

(10) Patent No.: US 10,407,894 B2
(45) Date of Patent: Sep. 10, 2019

(54) RIBBED SPINE STUD WITH VARIABLE WEB

(71) Applicant: INVENT TO BUILD, INC., Richmond Hill (CA)

(72) Inventor: Michael R. Strickland, Richmond Hill (CA)

(73) Assignee: INVENT TO BUILD INC., Richmond Hilll, ON (CA)

( * ) Notice: Subject to any disclaimer, the term of this patent is extended or adjusted under 35 U.S.C. 154(b) by 0 days.

(21) Appl. No.: 15/984,230

(22) Filed: May 18, 2018

(65) Prior Publication Data

US 2018/0334793 A1 Nov. 22, 2018

(30) Foreign Application Priority Data

May 19, 2017 (CA) ..... 2967628

(51) Int. Cl.

| | |
|---|---|
| ***E04B 1/24*** | (2006.01) |
| ***E04C 3/06*** | (2006.01) |
| ***E04C 3/07*** | (2006.01) |
| ***E04B 2/76*** | (2006.01) |
| ***E04B 2/78*** | (2006.01) |
| *E04C 3/04* | (2006.01) |

(52) U.S. Cl.

CPC ..... *E04B 1/2403* (2013.01); *E04B 2/763* (2013.01); *E04B 2/789* (2013.01); *E04C 3/065* (2013.01); *E04C 3/07* (2013.01); *E04B 2001/2409* (2013.01); *E04B 2001/2469* (2013.01); *E04C 2003/0421* (2013.01); *E04C 2003/0434* (2013.01); *E04C 2003/0473* (2013.01)

(58) Field of Classification Search

CPC ..... E04B 1/2403; E04B 2/763; E04B 2/789; E04B 2001/2469; E04B 2001/2409; E04C 3/065; E04C 3/07; E04C 2003/0473

USPC ..... 52/633

See application file for complete search history.

(56) References Cited

U.S. PATENT DOCUMENTS 2,781,110 A * 2/1957 Weller ..... E04B 1/2403 403/201
4,578,979 A * 4/1986 Abe ..... B21B 1/0805 72/177

(Continued)

FOREIGN PATENT DOCUMENTS

CA 2959843 A1 * 3/2016 ..... B21D 5/08
DE 102011009544 A1 * 8/2012 ..... B66C 6/00

OTHER PUBLICATIONS

Translation for DE 102011009544 A1 (Year: 2012).*

*Primary Examiner* — Jeanette E Chapman
(74) *Attorney, Agent, or Firm* — Hill & Schumacher

(57) ABSTRACT

A method of manufacturing a metal stud from a sheet of cold rolled steel includes the steps of: forming a central spine along a longitudinal centre of the sheet; forcing material outwardly from the central spine to form a thin central zone having a reduced thickness; forming embossments in at least the thin central zone; and forming the sheet into a generally C-shaped member. A stud made from a sheet of cold rolled steel includes a web and a pair of flanges. The web has an elongate central spine, a thin central zone and embossments extending outwardly from the elongate central spine. The pair of flanges extend generally orthogonally from the web. A stud system includes at least two studs and a bridging member extending between adjacent studs.

42 Claims, 19 Drawing Sheets

(56) References Cited

U.S. PATENT DOCUMENTS

| | | | | |
|---|---|---|---|---|
| 4,969,346 | A * | 11/1990 | Bosl | B21D 5/08 72/177 |
| 8,225,581 | B2 * | 7/2012 | Strickland | E04C 3/07 52/481.1 |
| 8,646,303 | B2 | 2/2014 | Welser et al. | |
| 2009/0205390 | A1 | 8/2009 | Hermann et al. | |
| 2015/0240486 | A1 * | 8/2015 | Sacks | E04C 3/00 52/633 |

* cited by examiner

RIBBED SPINE STUD WITH VARIABLE WEB

CROSS-REFERENCE TO RELATED APPLICATIONS

This application claims the priority benefit of Canadian Patent Application No. 2,967,628 filed on May 19, 2017, which is incorporated by reference.

FIELD OF THE DISCLOSURE

This disclosure relates to structural members and in particular stubs having a thin web portion.

BACKGROUND

In 2005 a new interior wall stud called ULTRA STEEL™ was introduced in North America. The technology originated in the UK (invented by Hadley et al) wherein the material was deformed such that it was very difficult to determine the original thickness of the material used. It was reported that ULTRA STEEL™ utilized 0.015" material thickness versus the industry standard of 0.018", this provided a 16% savings in weight in an industry where material weight was traditionally a majority of the cost of production. Load tables for the product were provided that verified the capacity of ULTRA STEEL™ to meet the span requirements similar to SSMA (Steel Stud Manufacturing Association) studs. When testing the ULTRA STEEL™ stud to determine its capacity for flexural resistance (by testing the stud only), it did not have the same flexural capacity as a standard 0.018" stud. It turned out ULTRA STEEL™ used composite assembly system testing with the drywall installed on the studs to reduce deflection when loaded. While ULTRA STEEL™ met certain code requirements for wall deflection based on composite testing, contractors found that the thinner metal being used caused screws to strip when installing drywall. However, the nature of the embossing pattern created a serrated edge on the lip that sometimes cut the fingers of the workers when handling the studs. The new disruptive technology also caused the stud to be weakened in torsion, so it was harder to twist the stud into the track. As a result of the ULTRA STEEL PRODUCT disrupting the market, the stud supply leaders in the industry went into improvement mode and a variety of embossing and rib patterns were developed and introduced by the industry.

Prior art technology to reduce weight use has been developed to provide materials with a variable section such as taught in U.S. Pat. No. 8,646,303. However, this technology is not best suited for a C-Shape stud where the material can be thinnest at the centre of the material strip where the web is located. Alternative technology is shown in U.S. Pat. No. 8,225,581 which provides a variable section with the material being thinnest, as desired, in the centre of the web of the C-shaped stud. To avoid local buckling and premature failure with very thin materials when loads are experienced, the region where there are two layers should be joined requiring an extra function in tooling. Two layers may create a faying area that could potentially attract moisture by virtue of capillary action. Thus two layers are generally not considered a preferred solution.

It would be advantageous to provide a new C-shaped stud that uses less material (than in a conventional) stud but has similar end user characteristics, strength and bending properties compared to the conventional stud.

SUMMARY

A method of manufacturing a metal stud from a sheet of cold rolled steel is disclosed. The method includes the steps of: forming a central spine along a longitudinal centre of the sheet; forcing material outwardly from the central spine to form a thin central zone having a reduced thickness; forming embossments in at least the thin central zone; and forming the sheet into a generally C-shaped member.

The C-shaped member may include a central web and a pair of opposed flanges extending generally orthogonally from the central web.

The method may include the step of forming a pair of lips extending inwardly from the pair of opposed flanges.

The method may include the step of punching a utility hole.

The step of forcing material outwardly from the central spine to form a thin central zone having a reduced thickness may take place in a plurality of forming stations.

The step of forming the sheet into a generally C-shaped member may take place in a plurality of forming stations.

A stud made from a sheet of cold rolled steel is also disclosed. The stud includes a web and a pair of flanges. The web has an elongate central spine, a thin central zone and embossments extending outwardly from the elongate central spine. The pair of opposed flanges extend generally orthogonally from the web.

The thin central zone may have a generally uniform thickness.

The thin central zone may be between a half and three quarters of the central web.

Thin central zone may be generally tapered from a thin centre portion proximate to the central spine to a thicker outer portion.

The thin central zone may be between a half and all of the central web.

The thin central zone may include a central portion having a generally uniform thickness and an outer portion being tapered from a thin portion proximate to the central portion to a thicker portion outwardly from the central portion.

The embossments may extend through the central spine.

The embossments may be generally oval extending outwardly from the central spine.

The embossments may be generally stretched ovals extending outwardly from the central restraining rib.

The embossments may be generally rectangular extending outwardly from the central restraining rib.

The embossments may be generally rectangular extending through the central restraining rib.

The thickness of the sheet is t and the thickness of the thin central zone is less than or equal to t/2

The stud may include a pair of lips extending inwardly from the pair of flanges.

The central spine may be formed in a spine zone and the spine zone may be generally the same as the thickness of the sheet of cold rolled steel before forming.

The embossments may extend into the spine zone and are spaced from the central spine.

The web may include side zones and the thickness of the side zones may be generally the same as the thickness of the sheet material of cold rolled steel before forming and the embossments extend into the side zones.

The thickness of the central spine may be generally the same as the thickness of sheet of cold rolled steel before forming or the same as the pair of flanges.

The thickness of the central spine may be generally the same as the thickness of the central zone.

The stud may include a plurality of slots formed therein wherein the slots are adapted to receive a bridging member.

A stud system includes at least two studs having a plurality of slots formed there and at least one bridging member extending between adjacent studs. The bridging member includes a bridging web a pair of bridging flanges extending downwardly therefrom and at least one downward tab at each end thereof. The downward tab hook onto the slots.

The width of the bridging members may be generally half the width of the studs.

There may be two downward tabs at each end of the bridging web.

The bridging member may include an upward tab extending upwardly from each end of the bridging web.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
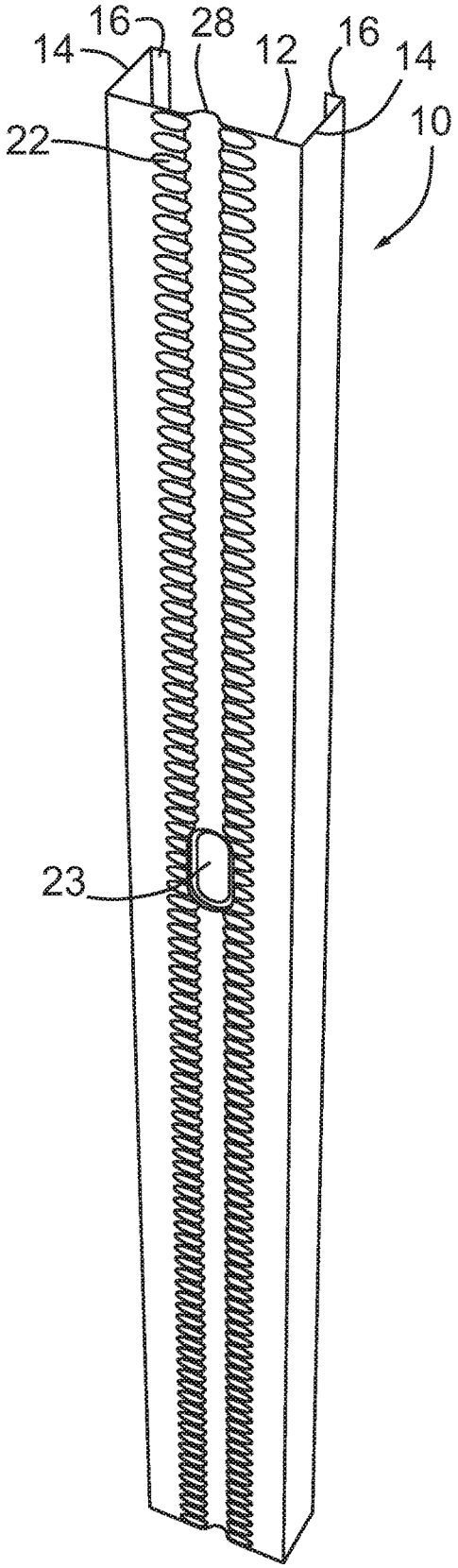
FIG. 1 is a perspective view of a thin web stud.

Referring to FIG. 1, a thin web stud is shown generally at 10. Thin web stud 10 has been created to overcome some of the shortcomings described in the Background by providing a cross section having a single layer of material. A method for producing the C-shaped stud 10 is described below. The method describes how to reduce material thickness at the central area of the strip width (the center of the web) by doing the reduction work before starting the formation of the C-shape.

Figure 2:
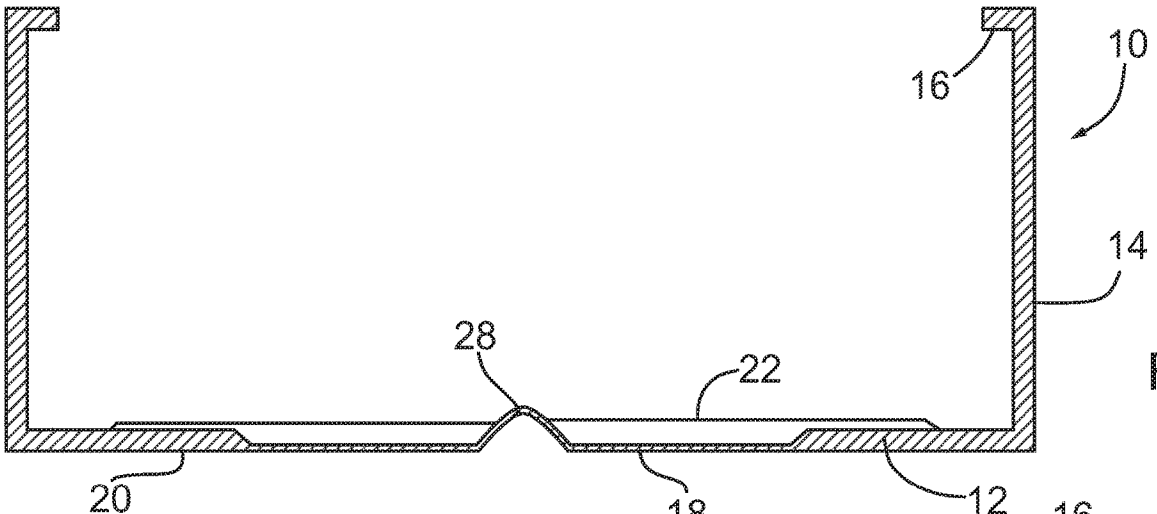
FIG. 2 is cross sectional view of the thin web stud of FIG. 1 taken between embossments.
Figure 3:
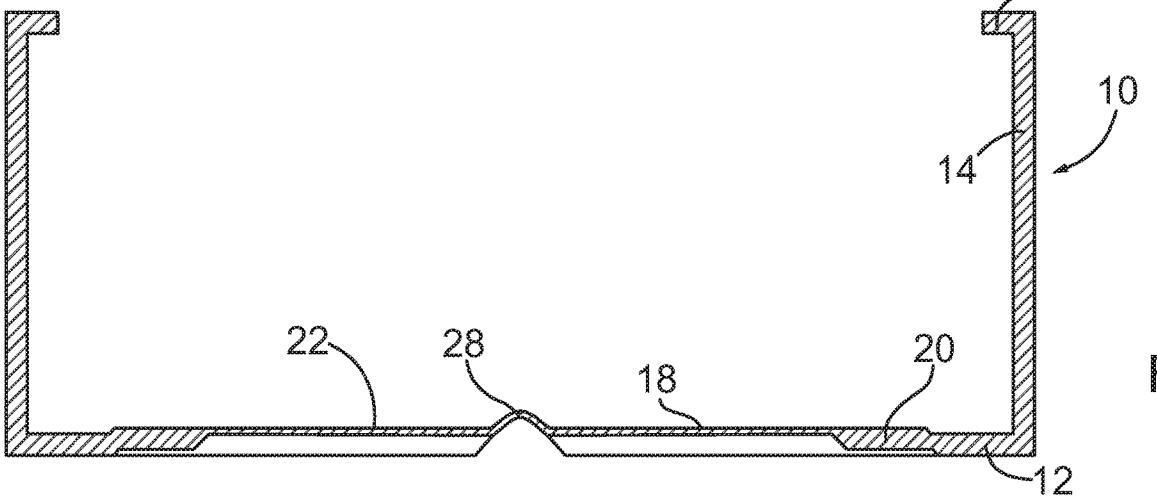
FIG. 3 is a cross sectional view of the thin web stud of FIG. 1 taken through one of the embossments.

The C-shaped stud 10 includes a web 12, a pair of opposed flanges 14 extending generally orthogonally therefrom and a pair of lips 16 respectively extending inwardly from the pair of flanges 14. As best seen in FIGS. 2 and 3, the web 12 has a thin central zone 18 and a pair of thick side zones 20. The web 12 has a plurality of embossments 22 formed therein. The stud 10 may have a central spine 28 which is a generally elongate central rib. Thus, the C-shaped stud 10 shown herein is a stud with a ribbed spine composed of the central spine 28 and the embossments 22 and a variable web composed of the thin central zone 18 and the thick side zones 20.

The C-shaped stud 10 will typically include a utility hole 23. It will be appreciated by those skilled in the art that the rectangular utility hole 23 shown herein is by way of example only and different shaped or sized holes may also be used. As well multiple utility holes may also be included.

Figure 4:
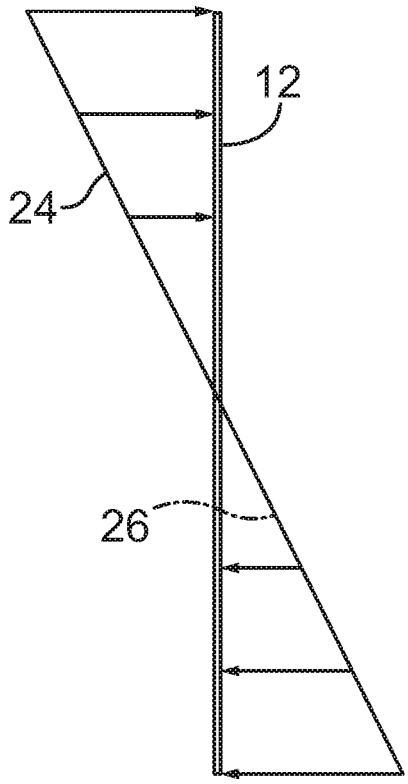
FIG. 4 is a schematic drawing of the loads on the web of the thin web stud of FIG. 1 subjected to flexural loading conditions.
Figure 5:
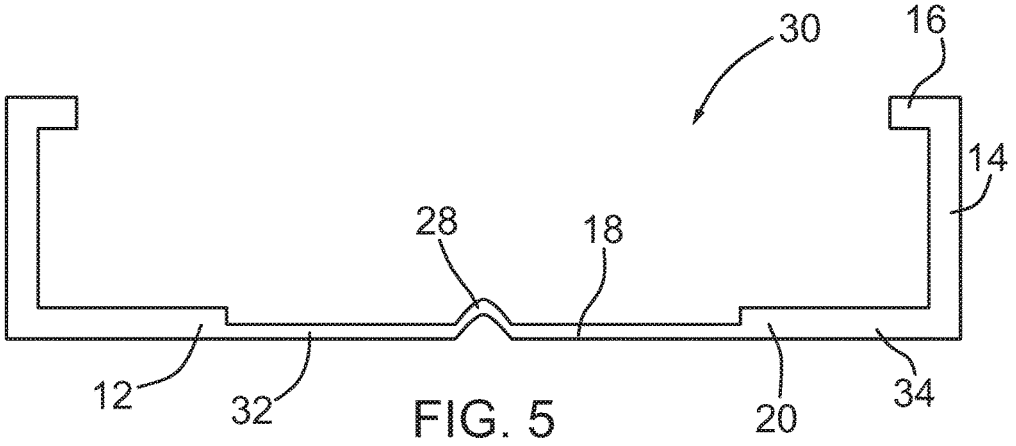
FIG. 5 is s cross sectional view of an alternate embodiment of the thin web stud, showing a stepped transition between a thin central zone and a thick side zone.
Figure 6:
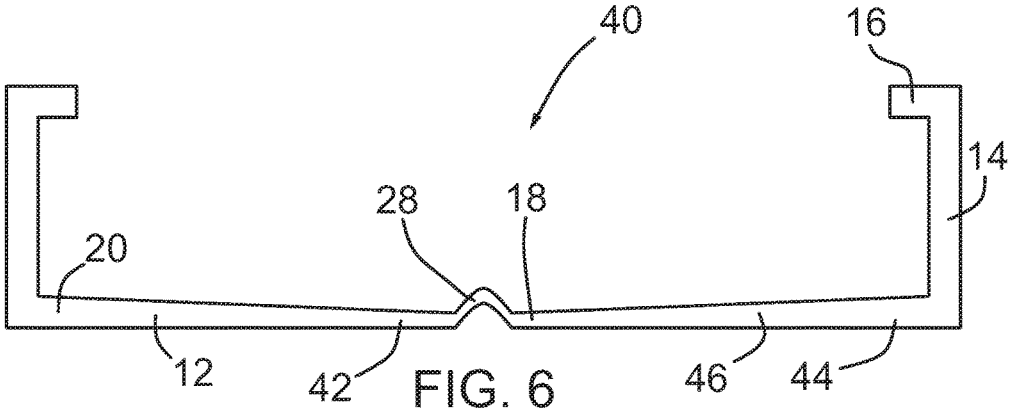
FIG. 6 is a cross sectional view of another alternate embodiment of the thin web stud, showing a thin central zone and a tapered thick side zone.
Figure 7:
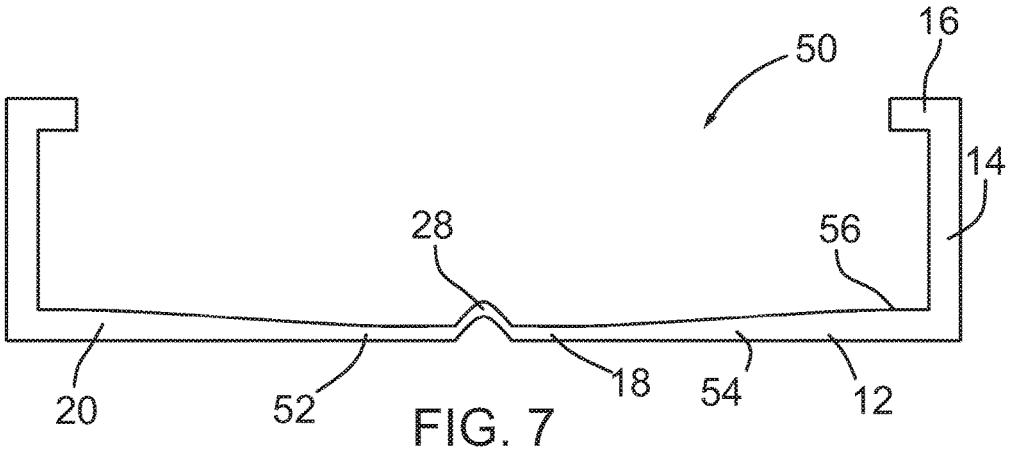
FIG. 7 is a cross sectional view of another alternate embodiment of the thin web stud, showing a thin central zone and a thick side zone that has a tapered portion and a side portion with a generally constant thickness.

It will be appreciated by those skilled in the art that the thin central zone 18 and the thick side zones 20 of the web 12 may have a number of different configurations. The web is designed to have a reduced thickness where the loads on a section of the stud are lower than in other sections of the stud. FIG. 4 shows the loads on a web 12 when the stud is loaded and subjected to flexure. As can be seen the load goes from compression 24 on one side of the web to tension 26 on the other side of the web. The maximum compression 24 is at one side of the web and then decreases towards the centre until it becomes neutral or zero and then the tension increases until it reaches a maximum at the other side of the web. The stud design shown herein has a reduced thickness in the central area of the web 12 where the compression stress and the tension stresses are lower. The thickness of the thin central zone may vary. By way of example only, typically if the thickness of the material is t, then the thickness of the thin central zone is up to but no less than t/2 are stated another way the thickness of the thin central zone is greater than or equal to t/2. The central zone may further include a spine zone and the spine zone may have a thickness that is different from the remainder of the central zone. By way of example the central zone may have a thickness of t/2 and the spine zone a thickness of t. By way of example only, a number of different web 12 configurations are shown in FIGS. 5 to 7. Referring to FIG. 5, a cross section of an alternate stud is shown at 30. The thin central zone 18 shown here as 32 and has a generally uniform thickness and in cross section has a width that is greater than half width of the web 12. The thick side zones 20 of stud 30 are shown generally at 34 and are generally the same thickness as the flanges 14 and lip 16. Referring to FIG. 6 a cross section of another alternate embodiment is shown at 40. The thin central zone 18 is shown generally at 42 and has a generally uniform thickness and in cross section has a width that is less than a quarter of the width of the web 12. The thick side zones 20 are shown generally at 44 and are tapered from the thin central portion proximate to the central spine 28 to a thicker outer portion 46 proximate to the flanges 14. Referring to FIG. 7 a cross section of another alternate embodiment of the C-shaped stud is shown at 50. The thin central zone 18 is shown generally at 52 and has a generally uniform thickness and in cross section has a width that is greater than a quarter and less than half the width of the web 12. The thick side zones 20 each have a tapered portion 54 and a side portion 56. The side portions 56 are generally uniform thickness and generally the same thickness as the flanges 14 and lip 16. The width of tapered portion 54 is greater than a quarter of the width of the web 12. As can be seen in these examples there may be a wide variety of thin central zones 18 and thick side zones 20. The transition between the thin central zone 18 and the thick side zones 20 may be a stepped transition as shown in FIG. 5. Alternatively, there may be a tapered transition from the thin central zone 18 to the flange 14 with the thick side zones 20 being a gradual transition as shown in FIG. 6 or a portion of the thick side zones 20 being a gradual transition 54 to a side portion 56.

In particular the flanges 14 of thin web stud 10 and the other embodiments are preferably at the industry standard thickness so there will not be any premature screw pull-out. Thin web stud 10 starts with an elongate rib placed at the centre of the strip that serves as a guide throughout the material reduction phase and prior to any forming of the C-Shape. After the central guidance rib is formed a succession of reductions to the material can take place from the centre, pushing the material outwards towards the outside of the strip. If the machinery and tooling are large enough to withstand the large loads, a single station could also form the rib and reduce the central region of the material concurrently.

Figure 8:
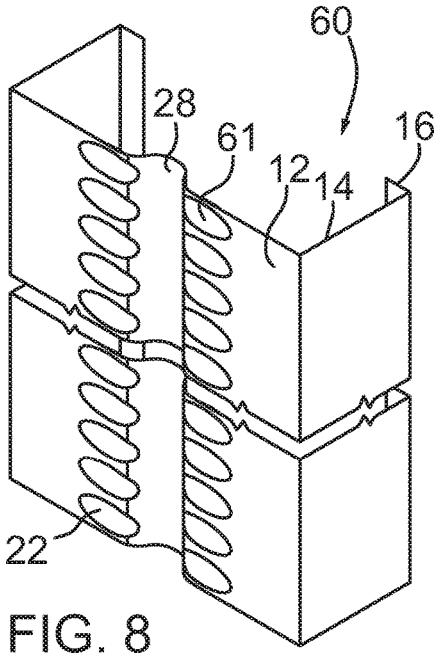
FIG. 8 is an enlarged perspective view of a portion of a thin web stud with a plurality of generally oval shaped embossments.
Figure 9:
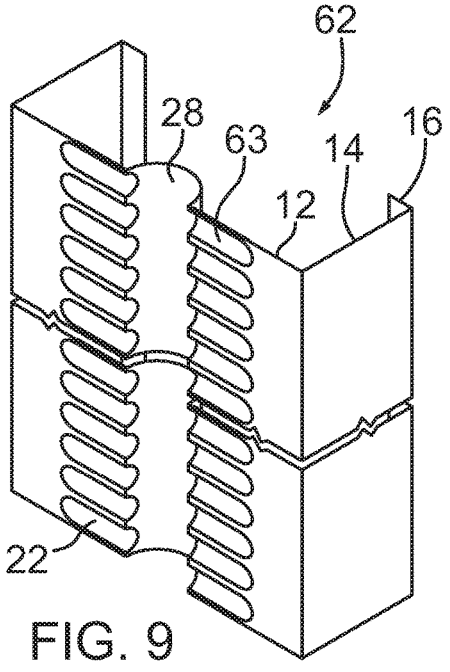
FIG. 9 is an enlarged perspective view of a portion of an alternate embodiment of a thin web stud with a plurality of generally stretched oval shaped embossments.
Figure 10:
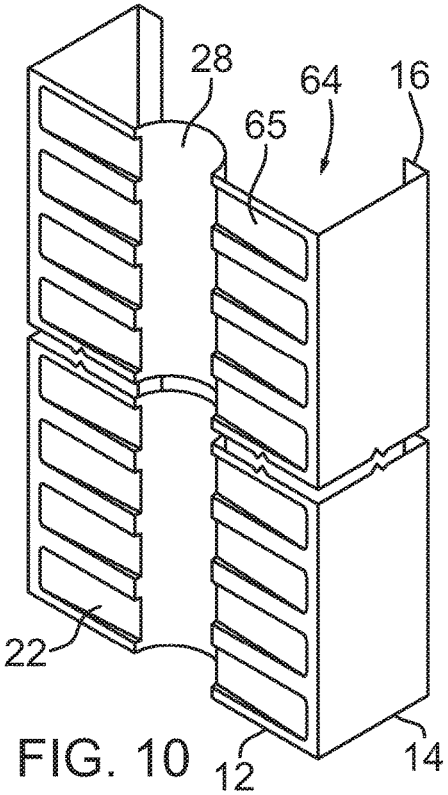
FIG. 10 is an enlarged perspective view of a portion of an alternate embodiment of a thin web stud with a plurality of generally rectangular shaped embossments.
Figure 11:
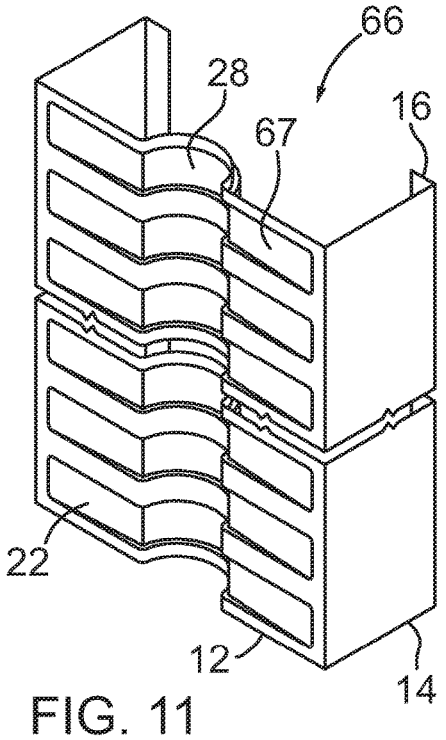
FIG. 11 is an enlarged perspective view of a portion of an alternate embodiment of a thin web stud with a plurality of generally rectangular shaped embossments that extend through the elongate central rib.

As discussed above the C-shaped stud 10 includes a plurality of embossments 22 extending laterally along the length of the stud. A wide variety of different shaped embossments may be used. By way of example different shaped embossments are shown in FIGS. 8 to 10. Referring to FIG. 8 the embossments 22 on stud 60 are shown at 61 and are generally oval and extend outwardly from either side of the central spine 28 and oval embossments on either side of the spine 28 cover less than half the width of the web 12. In FIG. 9 the embossments 22 on stud 62 are shown at 63 and are generally stretched ovals extending outwardly from either side of the central spine 28 and the embossments on either side of the rib 28 cove more than half the width of the web. In FIG. 10 the embossments 22 of stud 64 are shown at 65 and are generally rectangular in shape and extend outwardly from either side of the central spine 28 and the embossments cover most of the web 12. In FIG. 11 the embossments 22 on stud 66 are shown at 67 and are generally stretched rectangular and are formed in the web 12 through the central spine 28. As shown in FIG. 1 the embossments 22 are formed along the length of the stud 10. Similarly, the embossments would be formed along the length of studs 60, 62, 64 and 66 of FIGS. 8,9,10 and 11 respectively. However, it will be appreciated by those skilled in the art that a wide variety of shapes of embossments may be used.

Figure 12:
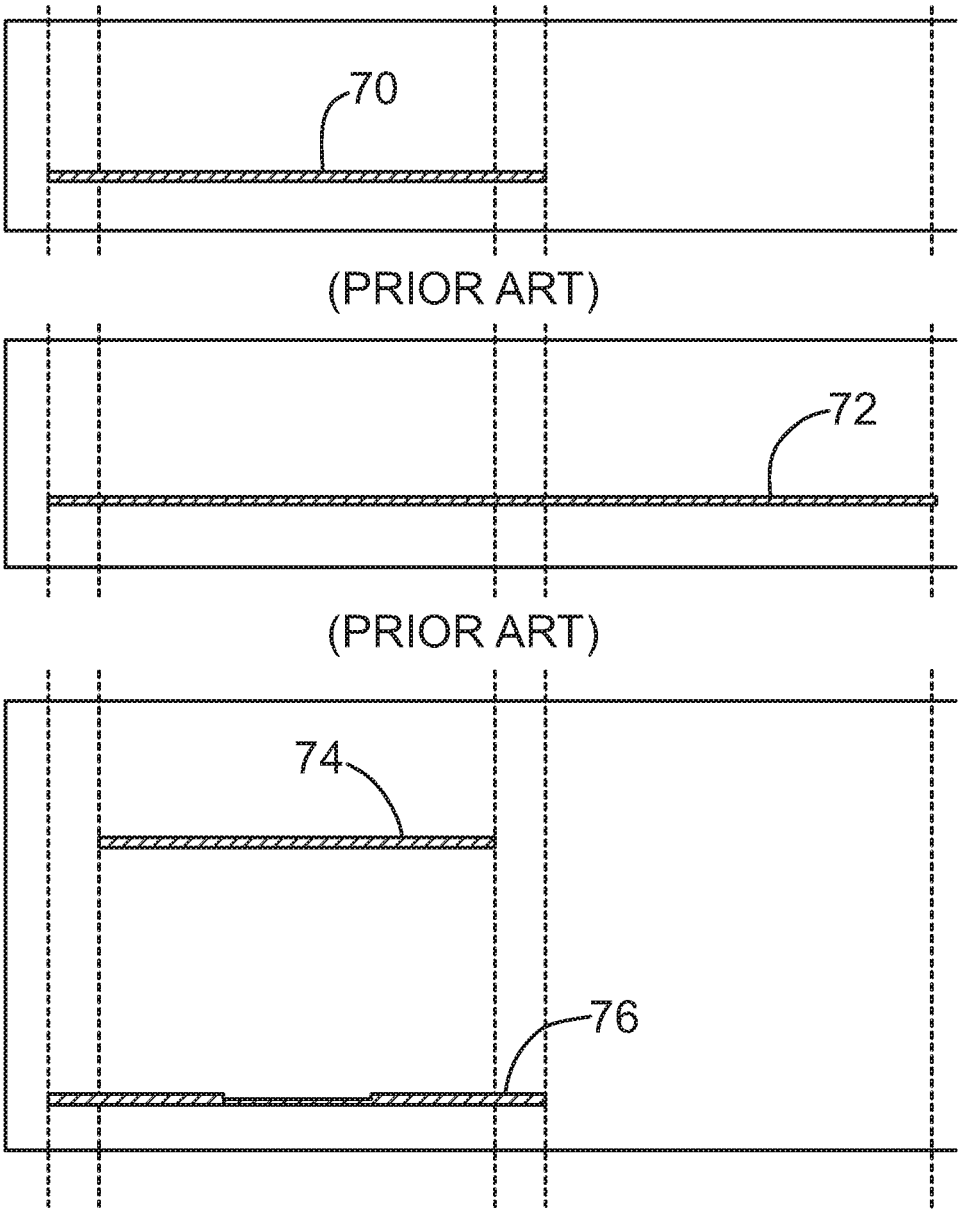
FIG. 12 is a schematic representation of the cross sections of the cold rolled steel used in prior art C-shaped members compared with the cold rolled steel of the thin web stud.

It will be appreciated by those skilled in the art that one of the advantages of the studs shown and described herein is that they use less steel than conventional studs while achieving comparable strength and bending properties while providing improvement in torsional resistance. FIG. 12 is a schematic diagram showing a comparison of the starting widths of the steel. The standard width for a cold rolled steel stud is 6.625 inches before it is bent into a C-shaped stud and is shown at 70. As will be appreciated by those skilled in the art when the steel is bent into a C shape the steel material will stretch and thus if the C-shaped stud was unbent it would be slightly longer than the original length due to stretching at the corners. Note this corner stretching will occur with all of the cold rolled steel studs discussed and referred to in FIG. 12. Typically, the prior art standard cold rolled steel uses 25 gauge steel with a material thickness of 0.018 inches. In comparison the width of steel 72 used in the double flanged stud of U.S. Pat. No. 8,225,581 is much wider at 11.125" but made of a thinner steel being generally 0.009" thickness. As discussed above there are some disadvantages to the double flanged stud. The starting width of the stud 10 described herein is shown at 74 is 5.5625". The starting width is less than that of the standard stud shown at 70. Typically, 25 gauge steel with a material thickness of 0.018 inches is used. There is at least a sixteen percent (16%) reduction in material which results in considerable material savings. The width of the material in stud 10 once the thin central zone 18 is formed therein is shown at 76 and the thickness of the remainder is generally the same as the original thickness that is 0.018 inches. As can be seen the width of the end piece 76 for stud 10 is comparable in width to the piece 70 for a standard stud. Please note that these dimensions are by way of example only and that in use the dimensions may change or the user may choose to change the thickness of the steel or the dimension of the stud.

Figure 13:
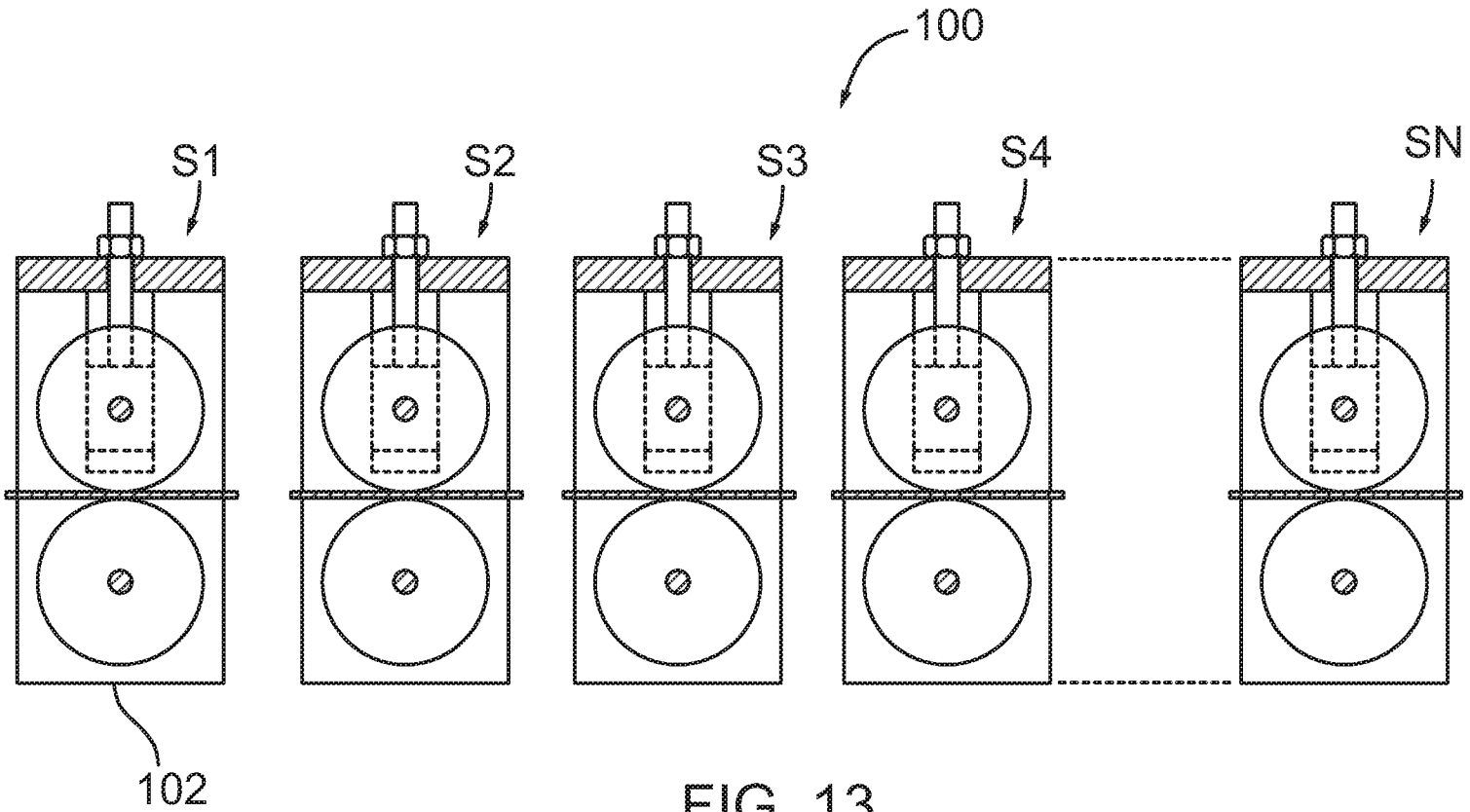
FIG. 13 is a schematic representation of the steps of the roll formed process.
Figure 14:
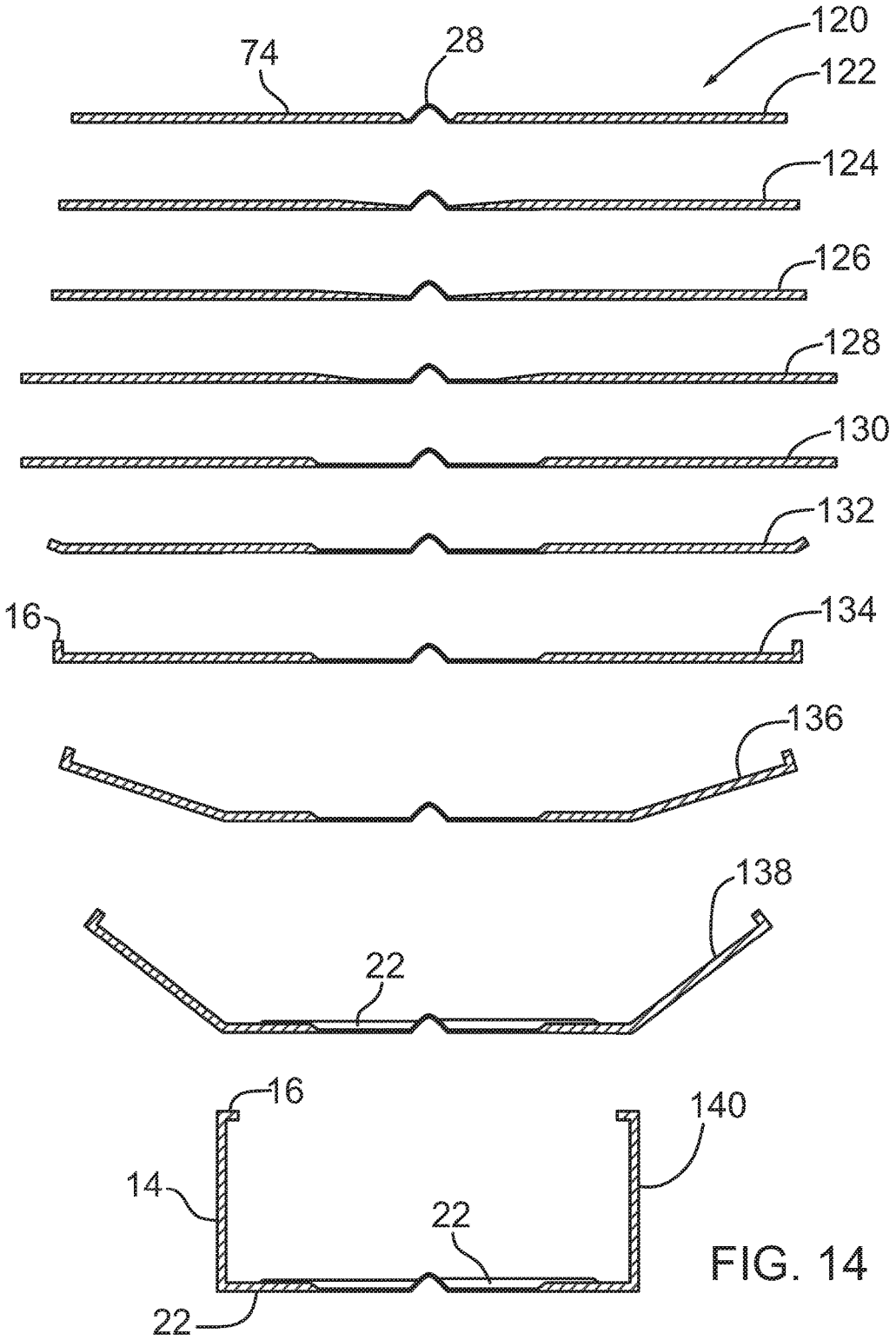
FIG. 14 is a schematic representation of the cross sections of the thin web stud as it is formed in steps of the process of shown in FIG. 13.
Figure 15:
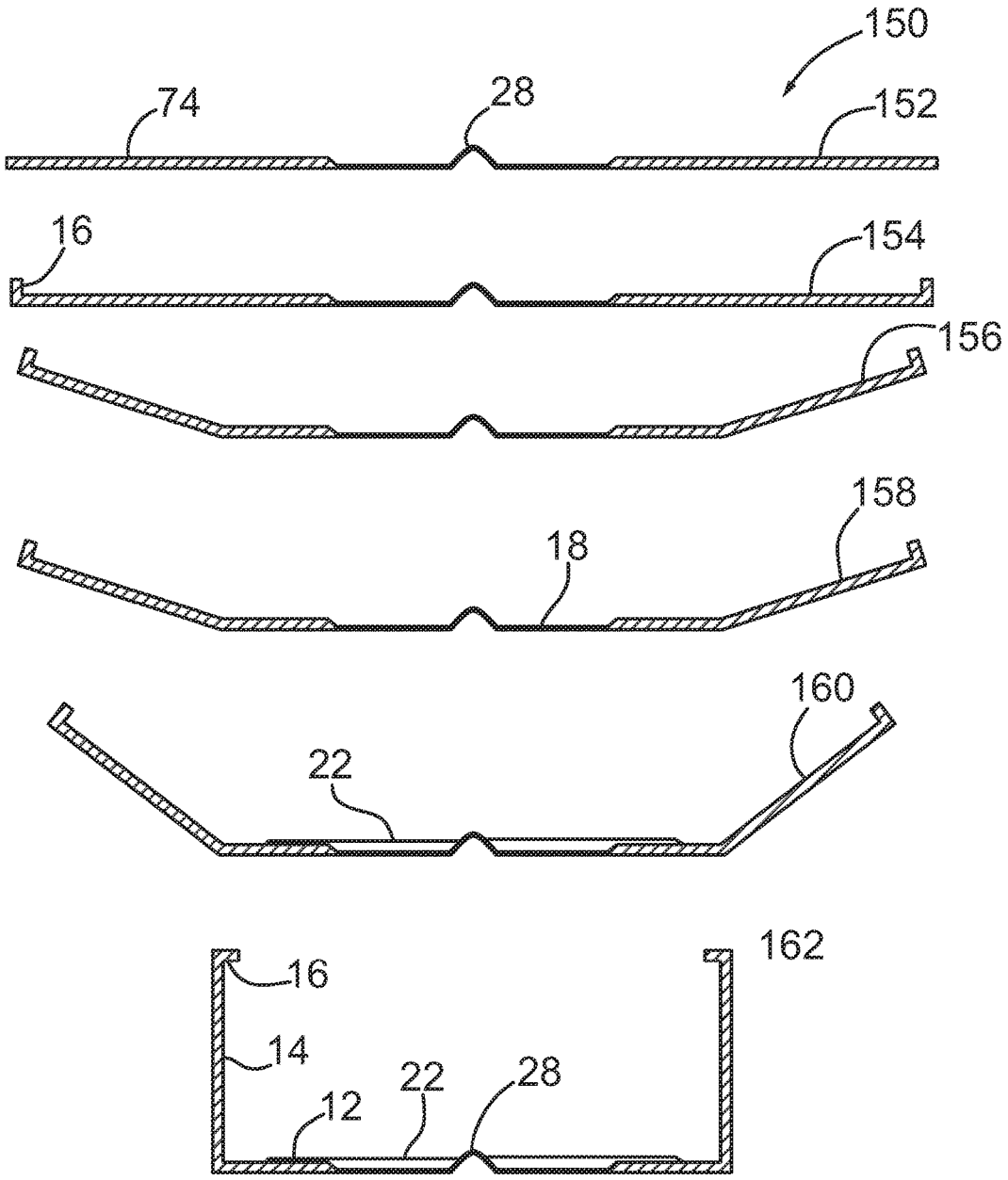
FIG. 15 is a schematic representation of the cross sections of the thin web stud as it is formed in alternate steps of the process of shown in FIG. 13.

Referring to FIG. 13 the system for manufacturing the thin web stud 10 is shown generally at 100. The system includes a plurality of roll forming stations 102. It will be appreciated by those skilled in the art that the number of stations will vary depending on the user. By way of example, different profiles at the various stages of the roll forming the material into a structural shape are shown in FIGS. 14 and 15. The process can be broken down into four major steps.

The first step is to form the central spine 28 in the sheet material 74 along the longitudinal centre of the sheet. The central spine 28 acts as a central stiffening rib. In the subsequent steps the thin central zone 18 is formed; embossments 22 are formed in at least the thin central zone 18; and the material is formed into a C-shaped member. The thin central zone 18 is formed by forcing material outwardly from the central spine 28. It will be appreciated by those skilled in the art that these steps may be executed in one or more roll forming station 102. By way of example, the steps of forming the central spine and forming the thin central zone may occur concurrently in a single step at a single roll forming station. As a further alternative the steps of forming the central spine, forming the thin central zone and forming the embossments may occur concurrently in a single step at a single roll forming station. Further, by way of example the step of forming the material into a C-shaped stud may occur in a plurality of steps in a plurality of roll forming stations. In addition some of the steps may occur concurrently. In addition, the step of punching a utility hole may also be included.

By way of example FIG. 14 shows a series of different cross sections generally at 120 that show the various stages of roll forming the material into the C-shaped member. In the first station an elongate central spine 28 is formed in the sheet material 74 as shown at 122. Then the beginnings of thin central zone 18 are beginning to be formed in the sheet material as shown at 124. In the next stations 126, 128 and 130 the width of the thin central zone 18 is progressively increased. In station 132 the lip 16 is starting to be formed. In station 134 the lip 16 is finished. In station 136 the flange 14 is starting to be formed. In station 138 the formation of the flange 14 is continued and the embossments 22 are formed. In station 140 the flange 14 is finished.

Referring to FIG. 15 a series of different cross sections are shown generally at 150. Cross sections 150 are similar to those shown in FIG. 14 but 150 shows a more aggressive displacement of the material. In the first station an central spine 28 and the thin central zone 18 are formed in the sheet material 74 as shown at 152. In station 154 the lip 16 is formed. In station 156 the flange 14 is starting to be formed. In station 158 the formation of the flange 14 is continued. In station 160 the formation of the flange 14 is further continued and the embossments 22 are formed. In station 162 the flange 14 is finished.

Figure 16:
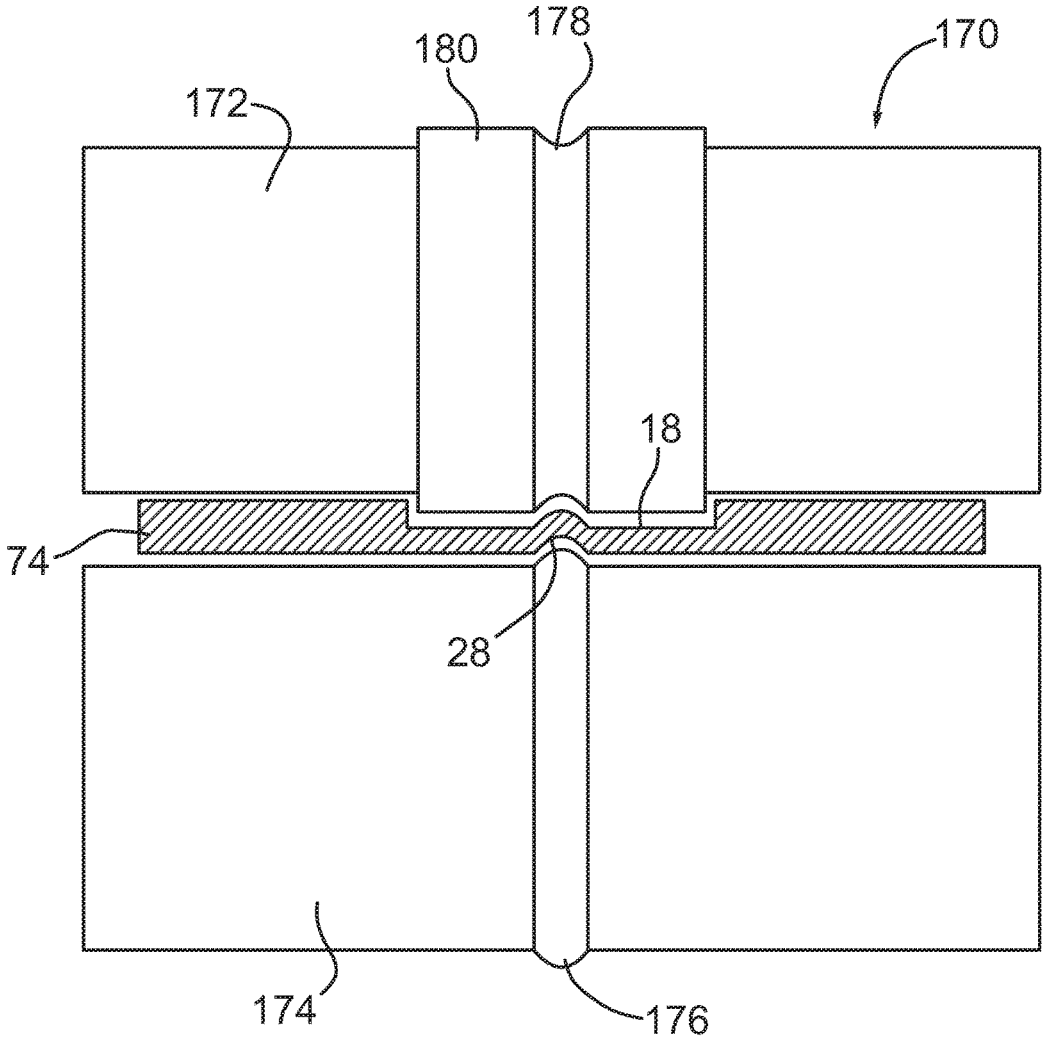
FIG. 16 is a cross sectional view of a reduction tool for use at one of the stations shown in the process of FIG. 13.

It will be appreciated by those skilled in the art that the number of stations may vary depending on how gentle or aggressive the manufacturer may choose to be when forming the stud. Further it will be appreciated by those skilled in the art that at each station there is a forming tool. By way of example a forming tool set 170 is shown in FIG. 16. The forming tool set 170 has a top roll tool 172 and a bottom roll tool 174. The bottom roll tool 174 has a central ridge 176 formed therein. The top roll tool 172 has a central groove 178 that is in registration with the ridge 176. Adjacent to the groove 178 is a strip portion 180 that extends downwardly. In use the central ridge 176 and the groove 178 form the spine 28 and the strip portion 180 forms the thin central zone 18.

The central spine 28 is used to guide the sheet material 74 through the initial roll forming stations. In particular the central spine 28 is used to guide the sheet material 74 in the portion of the process when the thin central zone 18 is formed therein. As shown by way of example in FIG. 16 the outer edges of the sheet material 74 are not constrained such that the sheet material can expand outwardly. Accordingly, during the forming of the thin central zone 18 the outer edges or the sheet material are not constrained. Thus, the central spine 28 and the thin central zone 18 are formed prior to forming the lips 16 and the flanges 14. It will be appreciated by one skilled in the art that restraining the sheet material outside of the area being reduced would create restraint against the material expanding sideways.

When metal is cold reduced, one experienced in the art understands that the material retains a large degree of residual stresses, this causes a cold reduced strip used for cold forming to want to distort (twist and turn horizontally and vertically) in an unpredictable manner. Distortion makes it difficult to feed a strip of metal through a roll former straight, this is why previous art always starts with bending and or folding at the sides at the initial stage, in order to guide the material prior to or at the reduction stage. One can understand that guiding the material from anywhere but only the centre, would restrain the material from stretching sideways. If the material stretches longitudinally, the entire section would likely be reduced in thickness and would therefore not be appropriate for providing an efficient C-Shape section.

Accordingly, a central spine 28 is rolled into the centre of the strip longitudinally. This spine 28 will be used to guide the material while the sheet is expanding from the centre outwards. The centre guidance spine 28 is used to guide the sheet material 74 when the material thickness is reduced in the central zone 18 of the web. By holding the sheet material in the middle, the continuous strip is allowed to expand outward. This is in contrast to the prior art wherein when roll forming a strip of material, typically it is guided through the rolling mill and Guided (held) by its outer edges. When the bends are placed in the material, they become the method for directing the material from one set of tools to the next.

Figure 17:
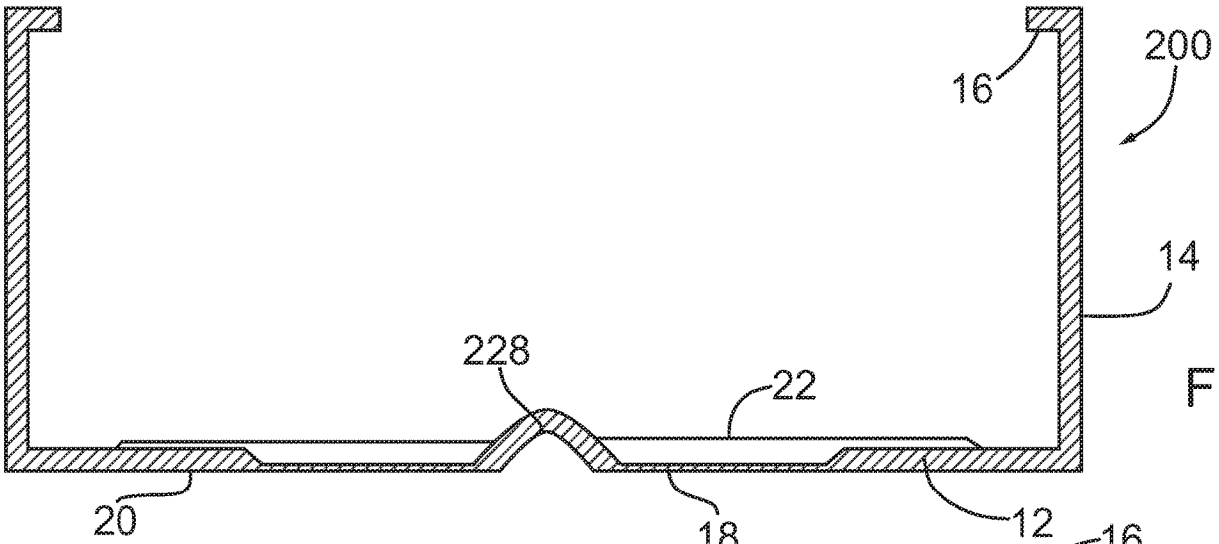
FIG. 17 is cross sectional view of the thin web stud taken between embossments similar to that shown in FIG. 2 but including a thicker spine.
Figure 18:
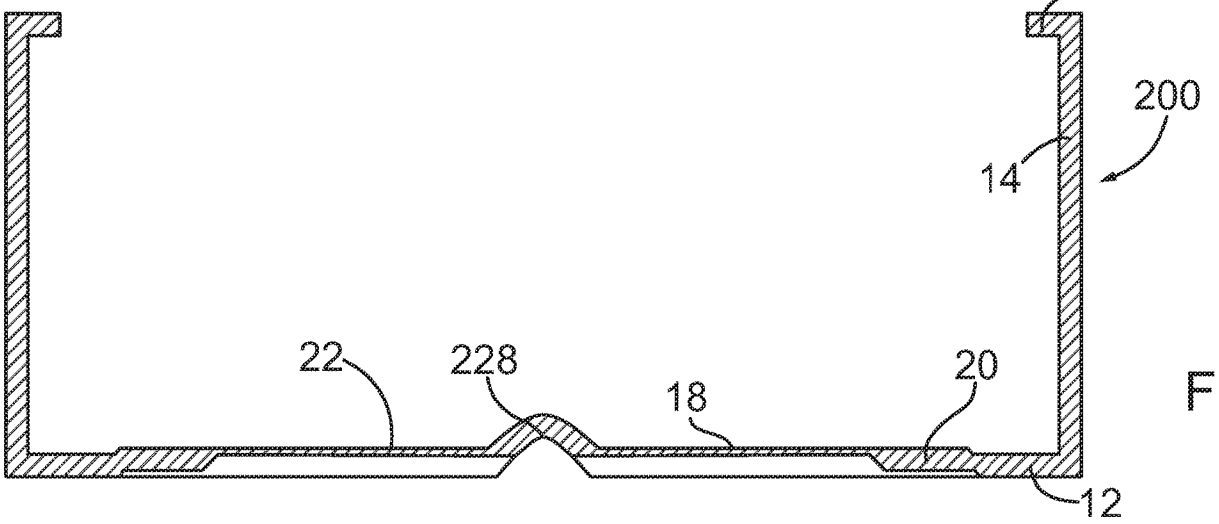
FIG. 18 is a cross sectional view of the thin web stud of FIG. 17 taken through one of the embossments.
Figure 19:
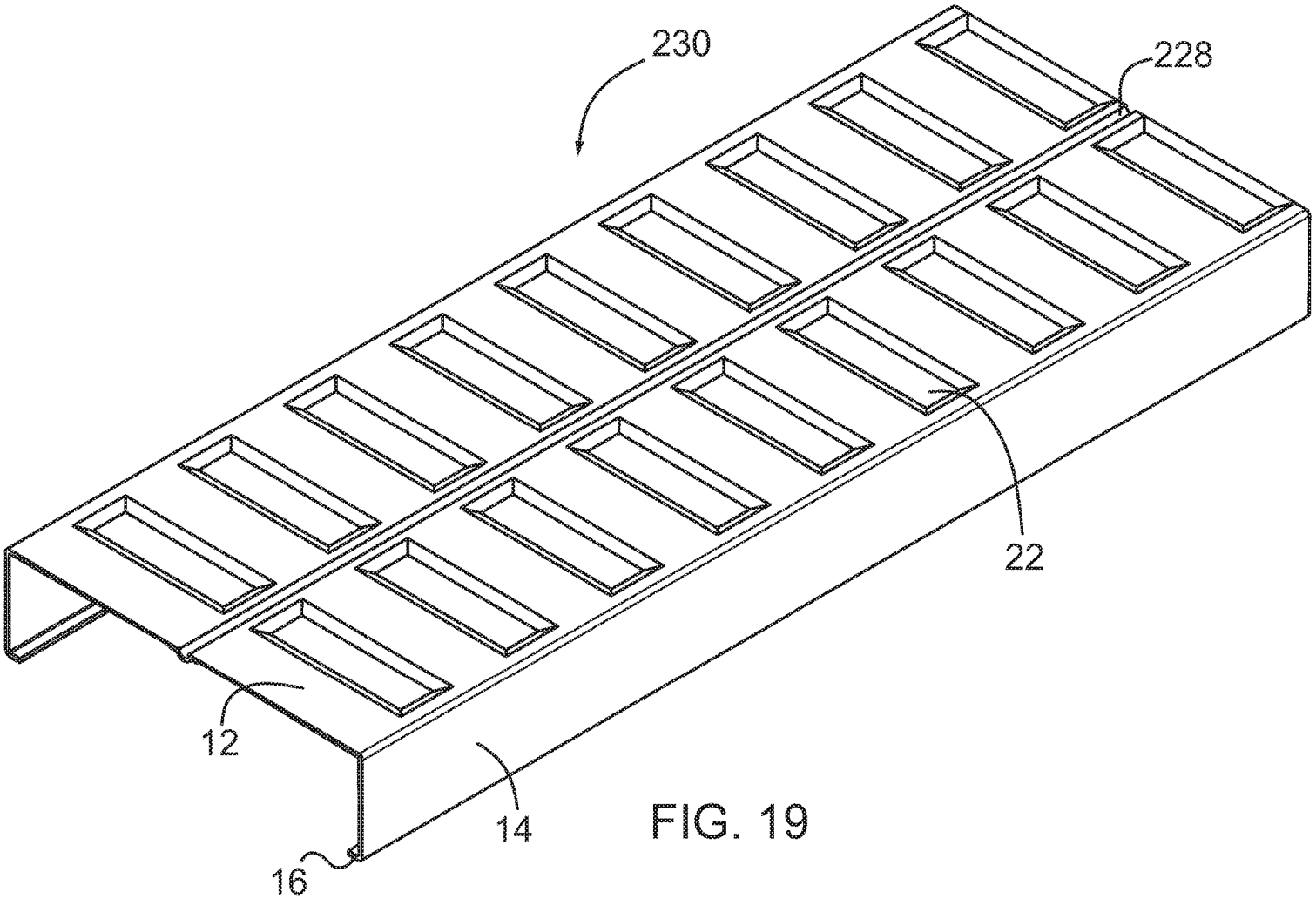
FIG. 19 is a perspective view of an alternate embodiment of a thin web stud with a plurality of generally rectangular shaped embossments.
Figure 20:
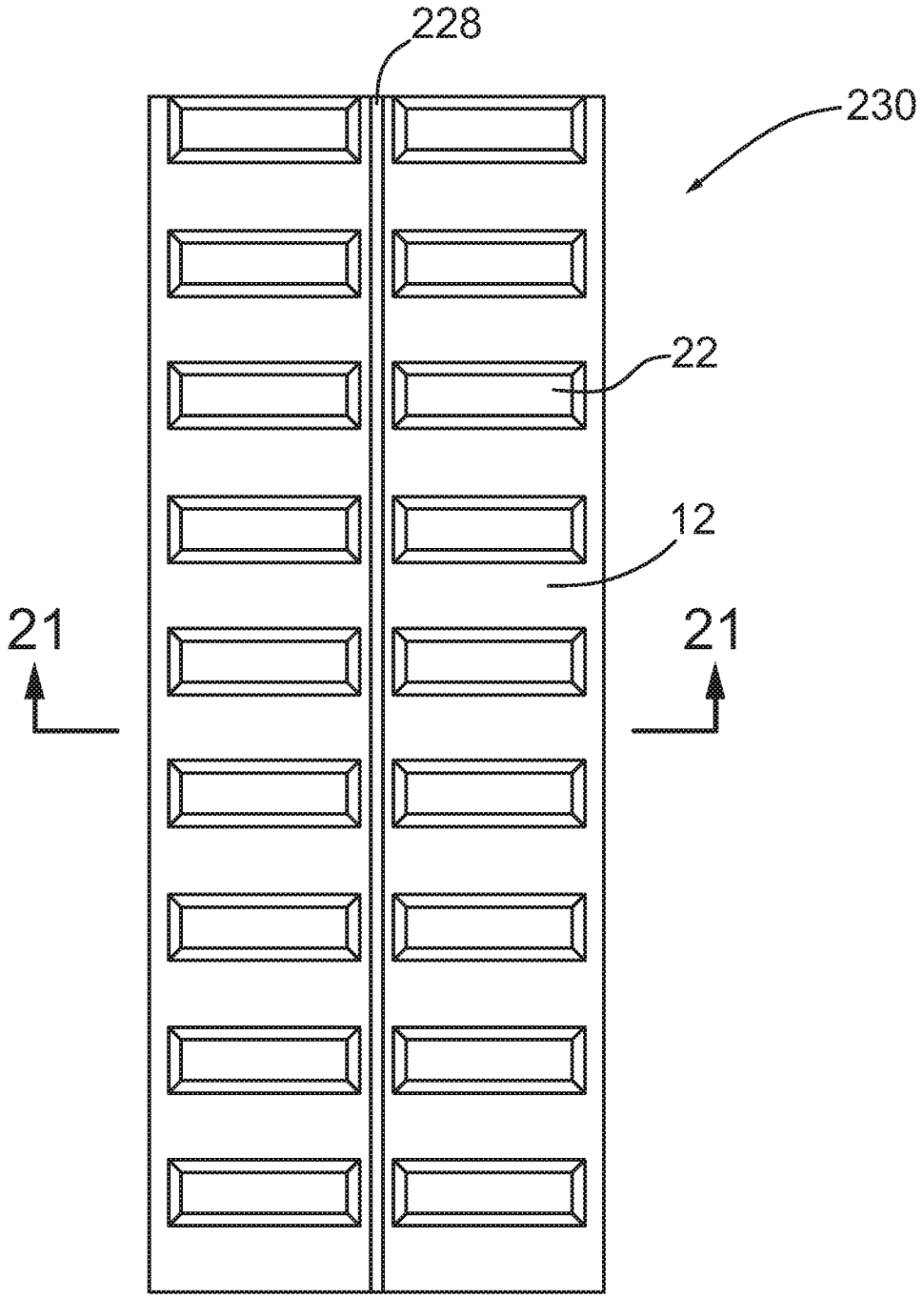
FIG. 20 is a front view of the thin web stud of FIG. 19.
Figure 21:
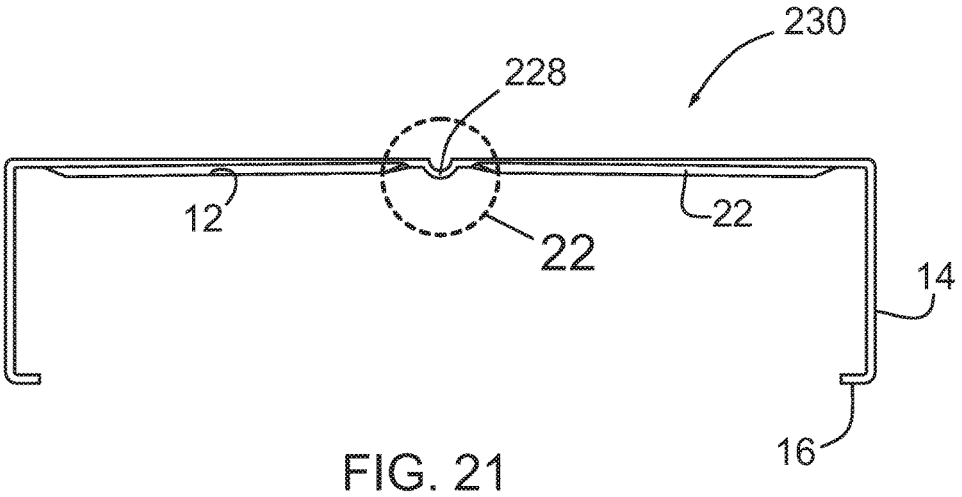
FIG. 21 is a cross sectional view of the thin web stud of taken along line 21-21 of FIG. 20.
Figure 22:
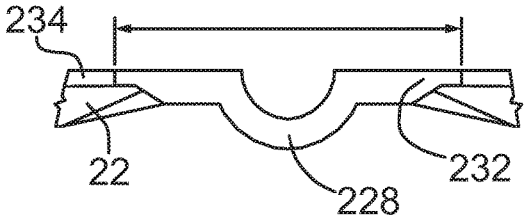
FIG. 22 is an enlarged cross sectional view of the rib of the thin web stud of FIG. 21.

Referring to FIGS. 17 and 18, an alternate embodiment of a C-shaped stud is shown generally at 200. The C-shaped stud 200 is similar to C-shaped stud 10 but it has a thicker central spine 228 as compared to the spine 28 shown in FIGS. 2 and 3 which has a thickness that is generally the same as the thickness of the thin central zone 18. C-shaped stud 200 includes a web 12, a pair of opposed flanges 14 extending generally orthogonally therefrom and a pair of lips 16 respectively extending inwardly from the pair of flanges 14. The web 12 has a thin central zone 18 and a pair of thick side zones 20. The web 12 has a plurality of embossments 22 formed therein. The stud 200 may have a central spine 228 which is a generally elongate central rib.

Central spine 228 has a thickness that is generally the same at flanges 14 or stated another way the thickness of central spine 228 is the same as the cold rolled steel before it is formed.

Referring to FIGS. 19 to 22, an alternate embodiment of a C-shaped stud is shown generally at 230. The C-shaped stud 203 is similar to C-shaped stud 200. Similarly it has a thicker central spine 228 as compared to the spine 28 shown in FIGS. 2 and 3 which has a thickness that is generally the same as the thickness of the thin central zone 18. C-shaped stud 230 includes a web 12, a pair of opposed flanges 14 extending generally orthogonally therefrom and a pair of lips 16 respectively extending inwardly from the pair of flanges 14. The web 12 has a spine zone 232 that is has a thickness that is generally the same at flanges 14 or stated another way the thickness of spine zone 232 is the same as the cold rolled steel before it is formed. Adjacent to the spine zone 232 is a pair of central zones 234. Adjacent to the central zones 234 are a pair of thick side zones 20. The thickness of the side zones 20 and the spine zone 232 are generally the same and generally t, the original thickness of the cold rolled steel. The central zones 234 generally gradually thin form the side zones 20 to the spine zone 232. The web 12 has a plurality of embossments 22 formed therein. The embossments 22 in the C-shaped stud 230 are generally rectangular. The embossments extend between the side zones 20 and the central zone 232 such that the outer side and the inner side of each of the generally rectangular embossments are formed in the thicker portions. The embossment extends into the spine zone 232 and are spaced from the central spine 228. Thus in C-shaped stud 23 are there are no notches in the material across the web 12 or there are not thin portions between a central spine and embossments. The stud 230 has a central spine 228 which is a generally elongate central rib. The central spine 228 is formed in the central zone 232.

Figure 23:
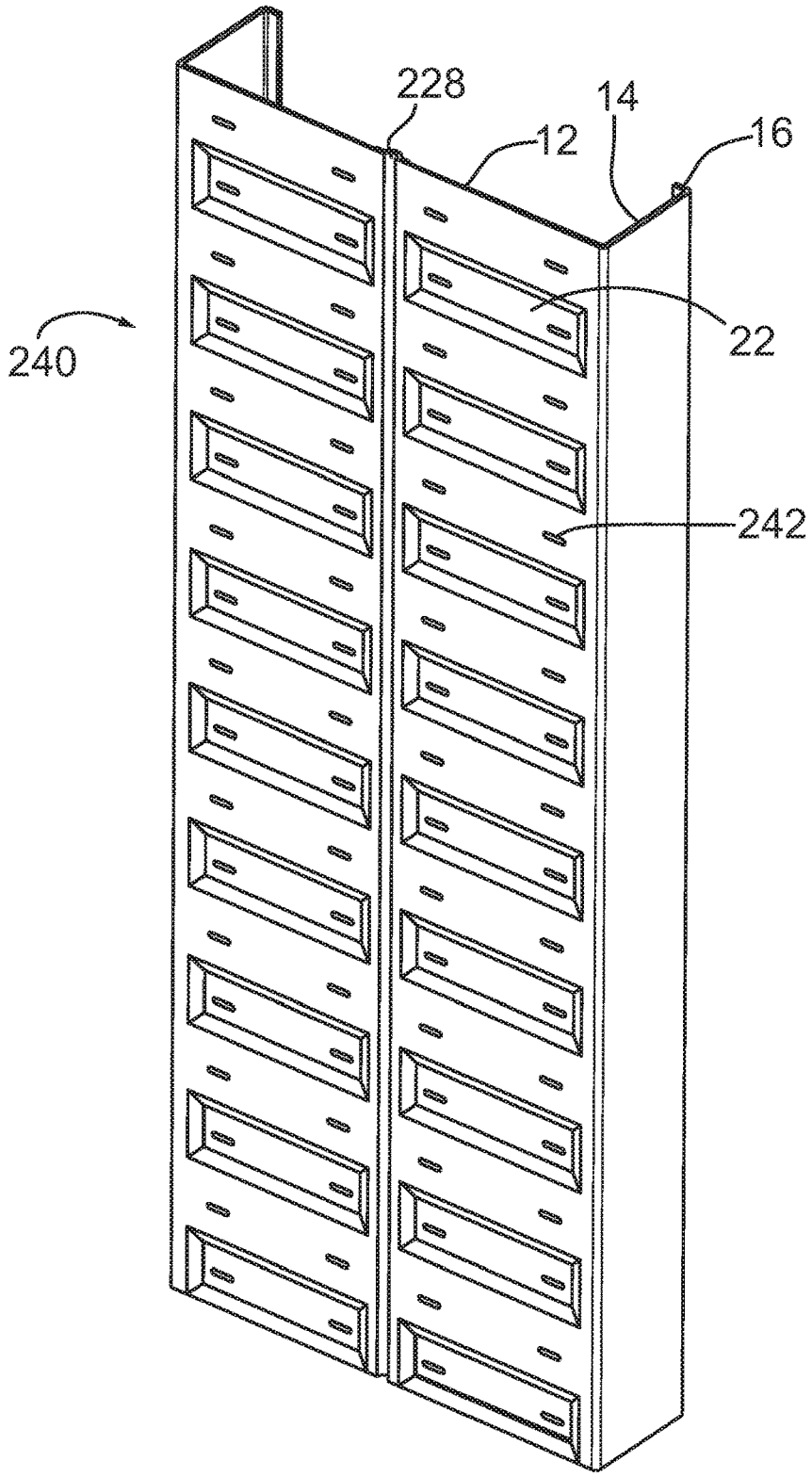
FIG. 23 is a perspective view of an alternate embodiment of a thin web stud with a plurality of generally rectangular shaped embossments similar to that shown in FIG. 19 but further including a plurality of slots.
Figure 24:
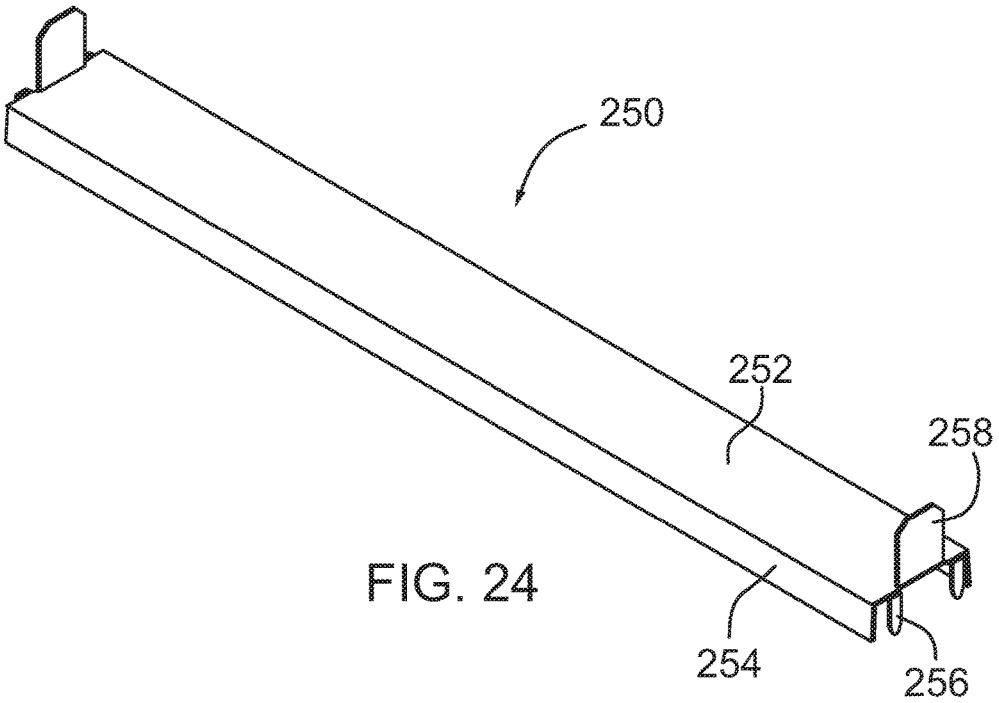
FIG. 24 is a perspective view of a bridging member for use in association with a thin web stud.
Figure 25:
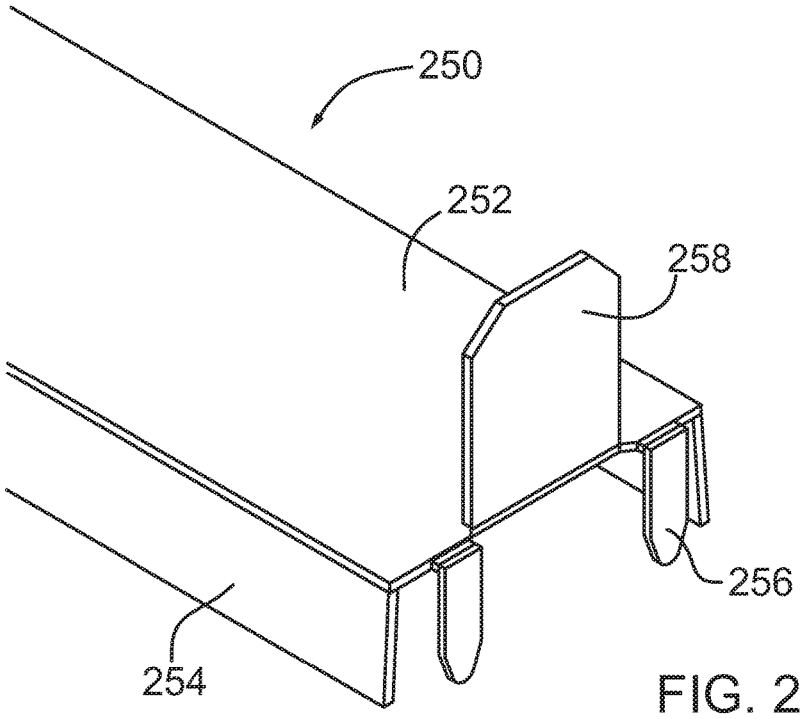
FIG. 25 is an enlarged perspective view of an end of the bridging member of FIG. 24.
Figure 26:
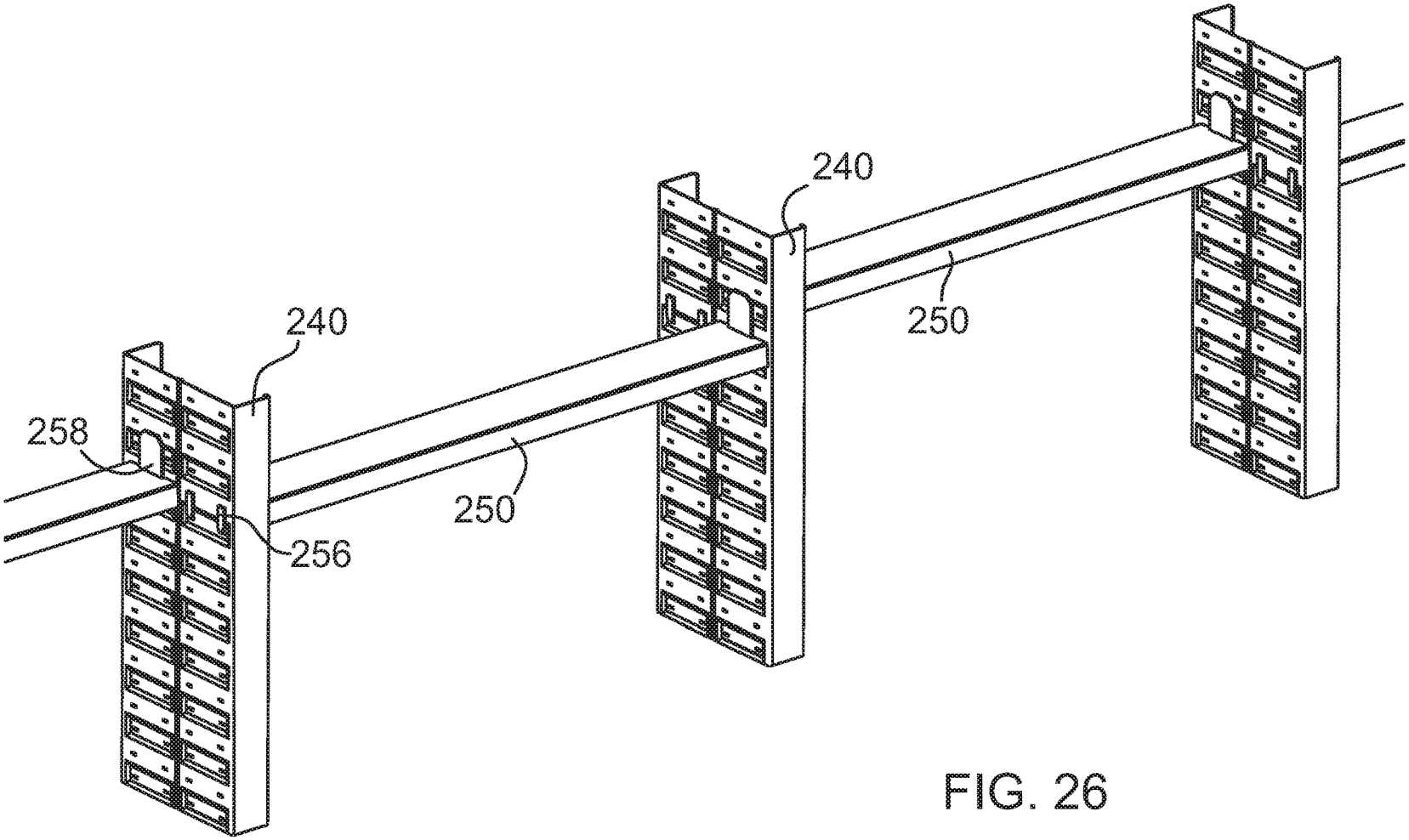
FIG. 26 is a perspective view of a stud system using a plurality of thin web studs of FIG. 23 and a plurality of bridging members of FIG. 24.
Figure 27:
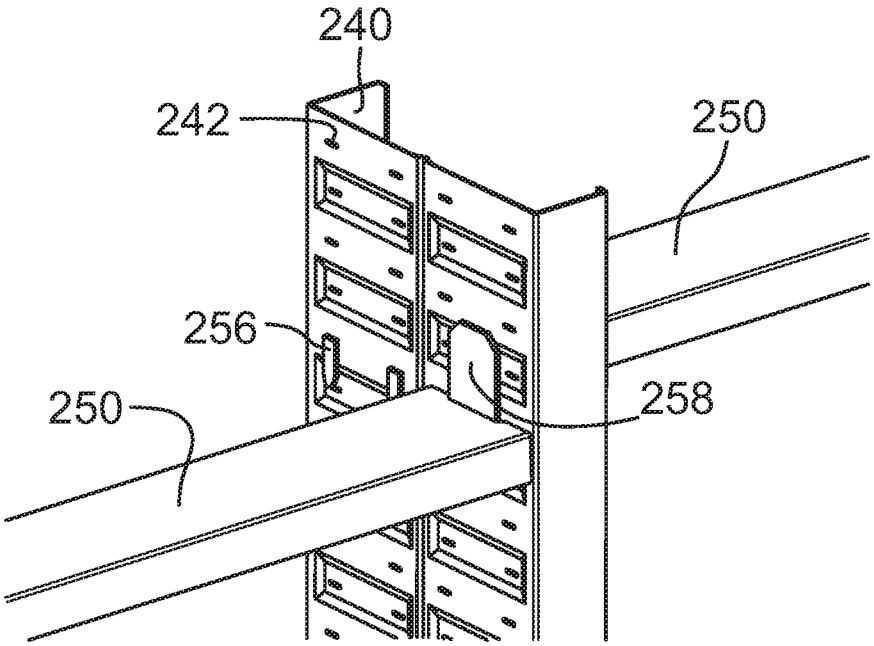
FIG. 27 is an enlarged perspective view of a thin web stud and bridging member connection of FIG. 26 as viewed from one side.
Figure 28:
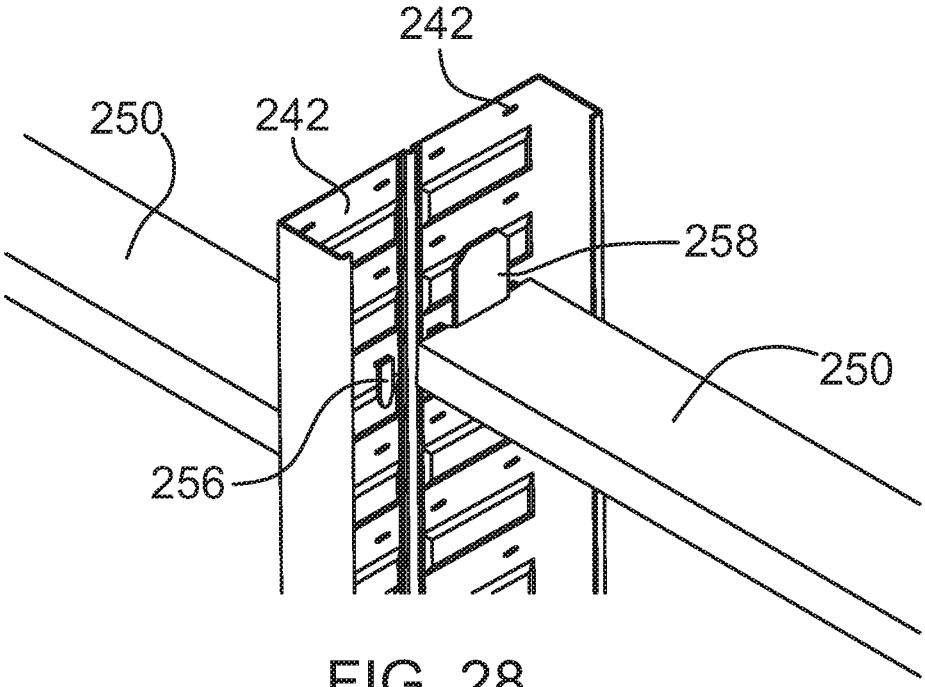
FIG. 28 is an enlarged perspective view of a thin web stud and bridging member connection similar to that shown in FIG. 27 but as viewed from the other side.
Figure 29:
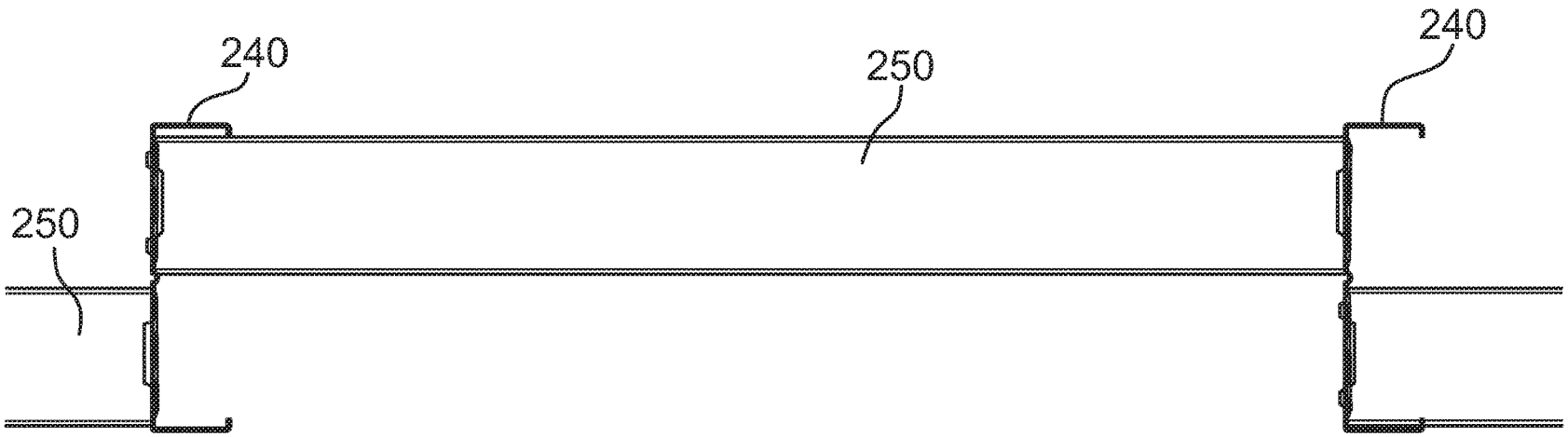
FIG. 29 is a top view of a portion of the stud system of FIG. 26.

The C-shaped stud 240 showed in FIG. 23 is similar to C-shaped stud 230 but further includes a plurality of slots 242 formed there. The slots are adapted to receive tabs from bridging members 250 shown in FIGS. 24 to 29. The slots are positioned both within the embossments 22 and between the embossments 22.

The bridging members 250 has a bridge web 252 and a pair of bridge flanges 254 that extend downwardly generally orthogonally therefrom. At least one downward tab 256 extends downwardly from the bridge web at each end thereof. In the embodiment shown herein there are a pair of downward tabs 256. The bridging member may include at least one upward tab 258 which extends upwardly from the bridge web 252 from each end thereof. The width of the bridging members 250 are generally half the width of the C-shaped member to which they are attached.

A stud system includes a plurality of C-shaped studs 240 and a plurality of bridging members 250. The downward tabs 256 of the bridging members 250 hook onto the slots 242 of the C-shaped studs 240. The upward tab 258 rests against the web 12 of the C-shaped stud 240. The bridging member is used to minimize rotation of the stud. As a general rule the less movement the better. As shown herein the embossments 22 provide resistance to web rotation using bridging members 250 that are generally half the width of the C-shaped stud 240.

It will be appreciated by those skilled in the art that the features of the different embodiments shown herein may be included in different configurations. For example, the different configurations of the thin central zone 18 shown in FIGS. 5 to 7 may be combined with the different embossments 22 shown in FIGS. 8 to 11. Similarly, the thicker central spine 228 may be combined with the different configurations of the thin central zone 18 and the different embossments.

Generally speaking, the systems described herein are directed to roll forming studs and a thin web stud. Various embodiments and aspects of the disclosure as described above with reference to details. The description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

What is claimed is:

1. A stud made from a sheet of cold rolled steel comprising:

a web having an elongate central spine, a thin central zone and embossments extending outwardly from the elongate central spine; and a pair of flanges extending generally orthogonally from the web, wherein the thin central zone is generally tapered from a thin centre portion proximate to the elongate central spine to a thicker outer portion.

2. The stud of claim 1 further including a pair of lips extending inwardly from the pair of flanges.

3. The stud of claim 1 wherein the thin central zone has generally uniform thickness.

4. A stud made from a sheet of cold rolled steel comprising:

a web having an elongate central spine, a thin central zone and embossments extending outwardly from the elongate central spine; and a pair of flanges extending generally orthogonally from the web, wherein the thin central zone includes a central portion having a generally uniform thickness and an outer portion being tapered from a thin portion proximate to the central portion to a thicker portion outwardly from the central portion.

5. The stud of claim 1 wherein the thin central zone is formed in between a half and all of the web.

6. The stud of claim 1 wherein the embossments extend through the elongate central spine.

7. The stud of claim 1 wherein the embossments are generally oval.

8. The stud of claim 1 wherein the embossments are generally stretched ovals.

9. The stud of claim 1 wherein the embossments are generally rectangular.

10. The stud of claim 1 wherein the embossments are generally rectangular extending through the elongate central spine.

11. The stud of claim 1 wherein the thickness of the sheet is t and the thickness of the thin central zone is greater than or equal to t/2.

12. The stud of claim 1 wherein the thickness of the elongate central spine is generally the same as the thickness of pair of flanges.

13. The stud of claim 1 wherein the central spine is formed in a spine zone and the spine zone is generally the same as the thickness of the sheet of cold rolled steel before forming.

14. The stud of claim 13 wherein the embossments extend into the spine zone and are spaced from the central spine.

15. The stud of claim 14 wherein the web includes side zones and the thickness of the side zones is generally the same as the thickness of the sheet material of cold rolled steel before forming and the embossments extend into the side zones.

16. The stud of claim 1 wherein the thickness of the elongate central spine is the same as the thickness of the then central zone.

17. The stud of claim 1 further including a utility hole formed therein.

18. The stud of claim 1 further including a plurality of slots formed therein wherein the slots are adapted to receive a bridging member.

19. A stud system comprising:

at least two studs of claim 1;

at least one bridging member extending between adjacent studs wherein the bridging member includes a bridging web a pair of bridging flanges extending downwardly therefrom and at least one downward tab at each end thereof; and wherein the downward tab hook onto the slots.

20. The stud system of claim 19 wherein the width of the bridging members are generally half the width of the studs.

21. The stud system of claim 19 wherein there are two downward tabs at each end of the bridging web.

22. The stud system of claim 19 the bridging member further includes an upward tab extending upwardly from each end of the bridging web.

23. The stud of claim 4 wherein the thin central zone is formed in between a half and three quarters of the web.

24. The stud of claim 4 further including a pair of lips extending inwardly from the pair of flanges.

25. The stud of claim 4 wherein the thin central zone has generally uniform thickness.

26. The stud of claim 4 wherein the embossments extend through the elongate central spine.

27. The stud of claim 4 wherein the embossments are generally oval.

28. The stud of claim 4 wherein the embossments are generally stretched ovals.

29. The stud of claim 4 wherein the embossments are generally rectangular.

30. The stud of claim 4 wherein the embossments are generally rectangular extending through the elongate central spine.

31. The stud of claim 4 wherein the thickness of the sheet is t and the thickness of the thin central zone is greater than or equal to t/2.

32. The stud of claim 4 wherein the thickness of the elongate central spine is generally the same as the thickness of pair of flanges.

33. The stud of claim 4 wherein the central spine is formed in a spine zone and the spine zone is generally the same as the thickness of the sheet of cold rolled steel before forming.

34. The stud of claim 4 wherein the embossments extend into the spine zone and are spaced from the central spine.

35. The stud of claim 4 wherein the web includes side zones and the thickness of the side zones is generally the same as the thickness of the sheet material of cold rolled steel before forming and the embossments extend into the side zones.

36. The stud of claim 4 wherein the thickness of the elongate central spine is the same as the thickness of the then central zone.

37. The stud of claim 4 further including a utility hole formed therein.

38. The stud of claim 4 further including a plurality of slots formed therein wherein the slots are adapted to receive a bridging member.

39. A stud system comprising:

at least two studs of claim 4;

at least one bridging member extending between adjacent studs wherein the bridging member includes a bridging web a pair of bridging flanges extending downwardly therefrom and at least one downward tab at each end thereof; and wherein the downward tab hook onto the slots.

40. The stud system of claim 39 wherein the width of the bridging members are generally half the width of the studs.

41. The stud system of claim 39 wherein there are two downward tabs at each end of the bridging web.

42. The stud system of claim 39 the bridging member further includes an upward tab extending upwardly from each end of the bridging web.

* * * * *